US010220975B2

(12) United States Patent
Carman

(10) Patent No.: US 10,220,975 B2
(45) Date of Patent: Mar. 5, 2019

(54) COLUMN AND CROSS STACKING CONTAINERS AND RELATED METHODS

(71) Applicant: INTEPLAST GROUP CORPORATION, Livingston, NJ (US)

(72) Inventor: Gregory A. Carman, Victoria, TX (US)

(73) Assignee: Inteplast Group Corporation, Livingston, NJ (US)

( * ) Notice: Subject to any disclaimer, the term of this patent is extended or adjusted under 35 U.S.C. 154(b) by 0 days.

(21) Appl. No.: 15/169,360

(22) Filed: May 31, 2016

(65) Prior Publication Data

US 2017/0341801 A1 Nov. 30, 2017

(51) Int. Cl.

| | |
|---|---|
| ***B65D 5/00*** | (2006.01) |
| ***B65D 5/42*** | (2006.01) |
| ***B65D 5/02*** | (2006.01) |
| ***B65D 5/66*** | (2006.01) |

(52) U.S. Cl.

CPC ..... *B65D 5/0015* (2013.01); *B65D 5/02* (2013.01); *B65D 5/4295* (2013.01); *B65D 5/6632* (2013.01)

(58) Field of Classification Search

CPC ..... B65D 5/103; B65D 5/4295
USPC ..... 229/127, 143, 178, 915, 919, 120, 229/122.32, 148
See application file for complete search history.

(56) References Cited

U.S. PATENT DOCUMENTS

| | | | | |
|---|---|---|---|---|
| 2,374,177 A | | 4/1945 | Conner et al. | |
| 2,721,689 A | | 10/1955 | Nye | |
| 2,844,294 A | * | 7/1958 | Williams | B65D 5/2066 229/120.03 |
| 3,369,728 A | | 2/1968 | Royce | |
| 3,973,723 A | * | 8/1976 | Owens | B65D 5/003 229/143 |
| 4,082,215 A | | 4/1978 | Eichenauer | |
| 4,105,117 A | | 8/1978 | Atkin et al. | |
| 4,134,533 A | | 1/1979 | Heavner | |
| 4,175,691 A | | 11/1979 | Cornell et al. | |

(Continued)

FOREIGN PATENT DOCUMENTS

CN 101160241 9/2008

OTHER PUBLICATIONS

CN101160241—Machine Translation of Application.

(Continued)

*Primary Examiner* — Christopher Demeree
(74) *Attorney, Agent, or Firm* — Matthew D. Thayne; Thayne and Davis LLC

(57) ABSTRACT

Containers for column or cross stacking and related methods. In some embodiments, the top wall of the container may comprise a first plurality of vent openings and the bottom wall may comprise a second plurality of vent openings. One or more of the first plurality of vent openings is configured to be aligned with one or more of a plurality of vent openings formed in a bottom wall of an adjacent container positioned above the container in a column-stacked configuration, and one or more of the first plurality of vent openings is configured to be aligned with one or more of the plurality of vent openings of the adjacent container in a cross-stacked configuration. Various stacking tabs/openings may also be provided, which may be configured to facilitate either cross or column stacking, as desired.

17 Claims, 11 Drawing Sheets

(56) References Cited

U.S. PATENT DOCUMENTS

| | | | | |
|---|---|---|---|---|
| 4,236,740 | A | 12/1980 | Sorenson et al. | |
| 4,245,773 | A | 1/1981 | Stollberg | |
| 4,347,968 | A * | 9/1982 | Cornell | B65D 5/003 229/120 |
| 4,597,503 | A | 7/1986 | Lates | |
| 4,770,339 | A | 9/1988 | Weimer | |
| 4,883,221 | A | 11/1989 | Brundage | |
| 4,911,355 | A | 3/1990 | Bannister | |
| 5,141,149 | A | 8/1992 | Fulton | |
| 5,325,602 | A | 7/1994 | Nainis et al. | |
| 5,328,080 | A | 7/1994 | Holley, Jr. | |
| 5,458,283 | A | 10/1995 | Southwell et al. | |
| 5,649,663 | A | 7/1997 | Pestow, Jr. | |
| 5,727,711 | A | 3/1998 | Edmond et al. | |
| 6,138,904 | A | 10/2000 | Baird et al. | |
| 6,158,652 | A | 12/2000 | Ruiz et al. | |
| 6,176,419 | B1 | 1/2001 | Holley, Jr. | |
| D447,938 | S | 9/2001 | Tsuruishi | |
| 6,390,357 | B1 | 5/2002 | Ogryzlo et al. | |
| 6,889,893 | B2 | 5/2005 | Kent | |
| 6,899,266 | B2 | 5/2005 | Conway | |
| 7,007,802 | B1 | 3/2006 | Moorman et al. | |
| 7,207,473 | B2 | 4/2007 | Fry | |
| 7,374,076 | B2 | 5/2008 | Holley | |
| 8,136,717 | B2 | 3/2012 | De Paula | |
| 8,490,809 | B2 | 7/2013 | Cadiente et al. | |
| 8,827,142 | B2 | 9/2014 | Smith | |
| 9,469,078 | B2 | 10/2016 | Aganovic | |
| 9,475,606 | B2 | 10/2016 | Ball | |
| 9,493,268 | B2 | 11/2016 | Loftin | |
| D773,294 | S | 12/2016 | Choi | |
| 9,527,622 | B2 | 12/2016 | Carman | |
| D786,063 | S | 5/2017 | Choi | |
| 2006/0157546 | A1 | 7/2006 | Holley | |
| 2009/0277954 | A1 | 11/2009 | De Paula | |
| 2010/0219232 | A1 | 9/2010 | Smith | |
| 2015/0246745 | A1 | 9/2015 | Loftin | |
| 2015/0251797 | A1 | 9/2015 | Carman | |

OTHER PUBLICATIONS

U.S. Appl. No. 14/726,201.

U.S. Appl. No. 15/712,013, Office Action dated Jan. 2, 2018, 11 pgs.

* cited by examiner

COLUMN AND CROSS STACKING CONTAINERS AND RELATED METHODS

SUMMARY

Embodiments of sheets configured to be assembled into foldable containers, such as foldable, plastic, produce containers, are disclosed herein, along with implementations of related methods. Finished containers are also described herein. In some embodiments, such sheets/containers may comprise a plastic, such as a corrugated plastic, and may be configured to be sufficiently sturdy to withstand multiple uses.

In preferred embodiments and implementations, the sheets may comprise various features to allow the containers to be either column-stacked or cross-stacked while eliminating or at least minimizing the problems associated with combining such stacking methods. Containers typically have stacking tabs and/or ventilation openings located for either column stacking or cross stacking.

Column-stacked containers are stacked directly above each other in the same orientation. Cross-stacked containers are stacked perpendicularly to each other and may alternative between containers aligned in one direction and a perpendicular direction as the stack progresses from bottom to top. Because the corners of the containers are typically where boxes are the strongest, aligning them directly on top of each other may be useful for achieving the greatest stacking strength. However, using only column stacking often results in a stack that is prone to tipping. Cross-stacking offers better stability, but can sacrifice stacking strength due to misaligned corners.

Thus, some embodiments and implementations disclosed herein may allow for alternatively column and cross-stacking containers in the same stack, and may provide various features, such as venting openings, stacking tabs, etc., that may facilitate such alternative stacking methods without sacrificing stability and/or blocking, or unduly blocking, venting. This may be particularly important for produce containers, since such containers are typically cooled and/or precooled by a variety of methods including, for example, hydro, ice, vacuum, and/or forced air. Each of these methods typically requires preferential, open paths through the containers to cool effectively and efficiently.

Because of the importance of rapid and efficient hydrocooling for produce containers, certain venting features disclosed herein may permit such cooling in either cross- or column-stacking configurations, even in the center of the stack/pallet.

Various other useful features may be provided in the various embodiments disclosed herein, such as features for adding stability to cross-stacking, various locking tabs or other locking features, and the like.

In a specific example of a container according to some embodiments, the container may comprise a first plurality of vent openings formed in a top wall of the container and a second plurality of vent openings formed in a bottom wall of the container. At least a subset of the first plurality of vent openings may be configured to be aligned with at least a subset of a plurality of vent openings formed in a bottom wall of an adjacent container positioned above the container in a column-stacked configuration. In some such embodiments, each of the first plurality of vent openings may be configured to be aligned with at least a subset of a plurality of vent openings formed in a bottom wall of an adjacent container positioned above the container in a column-stacked configuration. Similarly, at least a subset of the first plurality of vent openings may be configured to be aligned with at least a subset of the plurality of vent openings formed in the bottom wall of the adjacent container in a cross-stacked configuration. In some such embodiments, each of the first plurality of vent openings may be configured to be aligned with at least a subset of the plurality of vent openings formed in the bottom wall of the adjacent container in a cross-stacked configuration.

The container may comprise a plurality of stacking tabs and a plurality of stacking tab openings. In some embodiments, one or more (in some embodiments, each) of the plurality of stacking tabs is configured to be received in a stacking tab opening of an adjacent container in a column-stacked configuration. Similarly, one or more (in some embodiments, each) of the plurality of stacking tabs is configured to be received in a stacking tab opening of an adjacent container in a cross-stacked configuration. Similarly, one or more (or each) of the plurality of stacking tab openings is configured to receive a stacking tab of an adjacent container in a column-stacked configuration, and one or more (or each) of the plurality of stacking tab openings is configured to receive a stacking tab of an adjacent container in a cross-stacked configuration.

In some embodiments, the container is configured such that none of the first plurality of vent openings is blocked by an adjacent container in the column-stacked configuration, and the container is configured such that none of the first plurality of vent openings is blocked by an adjacent container in the cross-stacked configuration.

In some embodiments, the container is configured such that none of the second plurality of vent openings is blocked by an adjacent container in the column-stacked configuration, and the container is configured such that none of the second plurality of vent openings is blocked by an adjacent container in the cross-stacked configuration.

In some embodiments, at least a subset (in some embodiments, each) of the plurality of stacking tabs comprises a plurality of adjacent locking tabs configured for securing panels defining the container in place. In some such embodiments, each stacking tab of the at least a subset of the plurality of stacking tabs comprises a stacking tab assembly, which may comprise a first locking tab positioned on a first panel of the container; a second locking tab positioned on a second panel of the container; and a third locking tab positioned on a third panel of the container.

In some embodiments, the third locking flap may comprise a door configured to open to expose a slot for receiving the first locking tab and the second locking tab upon bending the door with respect to the third panel.

In another specific example of a container according to some embodiments, the container may comprise a top wall comprising a first plurality of vent openings and a bottom wall comprising a second plurality of vent openings. At least a subset of the first plurality of vent openings may be configured to be aligned with at least a subset of a plurality of vent openings formed in a bottom wall of an adjacent container positioned above the container in a column-stacked configuration, and at least a subset of the first plurality of vent openings may be configured to be aligned with at least a subset of the plurality of vent openings formed in the bottom wall of the adjacent container in a cross-stacked configuration. Some embodiments may further comprise one or more locking tabs extending from the top wall and one or more locking tab slots formed in the bottom wall.

In some embodiments, the locking tab(s) may be configured to be received in a locking tab slot formed in a first adjacent container positioned above the container in a first cross-stacked configuration along with a locking tab(s) from a second adjacent container extending adjacent and parallel to the container in an end-to-end configuration.

Some embodiments may further comprise a first side panel and a second side panel positioned adjacent and at least substantially parallel to the first side panel. In some such embodiments, the locking tab(s) may be formed in the first side panel and another locking tab(s) may extend from the second side panel adjacent to the first locking tab. Locking tabs from the first and second side panels, respectively, may be configured to be received in the locking tab slot formed in the first adjacent container positioned above the container in the first cross-stacked configuration along with two similar locking tabs from the second adjacent container extending adjacent and parallel to the container in an end-to-end configuration.

Some embodiments may further comprise a first door configured to extend adjacent and parallel to the locking tabs from the first and second side panels such that the first door, the locking tab from the first side panel, and the locking tab from the second side panel are configured to be received in the locking tab slot formed in the first adjacent container positioned above the container in the first cross-stacked configuration along with two locking tabs and a door from the second adjacent container extending adjacent and parallel to the container in an end-to-end configuration.

In some embodiments, one or more of the locking tab slots may be configured to alternatively serve as one of the second plurality of vent openings, depending upon the stacking orientation relative to other containers. For example, in some embodiments, one or more of the locking tab slots is configured to be aligned with a vent opening formed in a top wall of an adjacent container in a second cross-stacked configuration shifted relative to the first cross-stacked configuration.

In some embodiments, the first plurality of vent openings comprises a first subset of vent openings having a first shape, and the first plurality of vent openings comprises a second subset of vent openings having a second shape distinct from the first shape. Similarly, the second plurality of vent openings may comprise a first subset of vent openings having a third shape, and the second plurality of vent openings may comprise a second subset of vent openings having a fourth shape distinct from the third shape. In some such embodiments, the second plurality of vent openings comprises a third subset of vent openings having a fifth shape distinct from the third shape and distinct from the fourth shape. The third shape may be at least substantially identical to the first shape, the fourth shape may be at least substantially identical to the second shape, and the fifth shape may be identical, but rotated by ninety degrees, relative to the fourth shape.

In some embodiments, the top wall may be defined by a first top wall panel and a second top wall panel, wherein the first top wall panel is coplanar with the second top wall panel when the top wall is in a closed configuration. In some such embodiments, the top wall may comprise an open region positioned between the first top wall panel and the second top wall panel, which open region may further facilitate desired venting with adjacent containers.

In an example of a sheet for folding into a container according to some embodiments, the sheet may comprise a first top panel comprising a first plurality of vent openings and a first bottom panel comprising a second plurality of vent openings. The first plurality of vent openings may be configured to be aligned with a corresponding plurality of vent openings in an adjacent, identical container in a column-stacked configuration when the sheet has been folded into a container. At least a subset of the first plurality of vent openings may similarly be configured to be aligned with a corresponding plurality of vent openings in an adjacent, identical container extending perpendicular to the container in a cross-stacked configuration when the sheet has been folded into a container. The sheet may further comprise a plurality of stacking tabs and a plurality of stacking tab openings.

In some embodiments, each of the plurality of stacking tabs is configured to be received in a corresponding stacking tab opening of an adjacent, identical container in a cross-stacked configuration, and each of the plurality of stacking tab openings is configured to receive a corresponding stacking tab of an adjacent, identical container in a column-stacked configuration.

In some embodiments, at least a subset of the second plurality of vent openings is configured to be aligned with a corresponding vent opening of an adjacent, identical container in a first configuration relative to the adjacent, identical container, and to alternatively serve as a stacking tab slot for receiving a stacking tab from the adjacent, identical container in a second configuration relative to the adjacent, identical container.

In some embodiments, the at least a subset of the second plurality of vent openings is configured to receive adjacent stacking tabs from two adjacent, identical containers in the second configuration.

The features, structures, steps, or characteristics disclosed herein in connection with one embodiment may be combined in any suitable manner in one or more alternative embodiments.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION

Consistent with embodiments disclosed herein, foldable containers, such as reusable containers, may be utilized to store produce, along with foldable sheets for creating such containers. In some embodiments, such containers may comprise corrugated plastic containers. For example, in certain embodiments, the plastic containers disclosed herein may be configured to store and/or transport corn. Utilizing plastic containers offers certain benefits over conventional wood crates, wire crates, and/or wax-coated corrugated cardboard storage containers to store corn. For example, corrugated plastic containers configured to store corn consistent with embodiments disclosed herein may be reusable, may be assembled more quickly, may be generally lighter, may be less prone to causing injuries, may be generally more durable (especially through demanding harvesting, packing, post-harvest cooling, and shipping processes), may be may be recyclable or otherwise more sustainable, may resist mold growth, may provide certain container labeling and/or marking benefits, may be assembled/folded without requiring the use of additional adhesives or mechanical fastening, and/or may provide an improved sterile environment for packing fresh produce.

In some embodiments, such containers may be configured to allow for interchangeable cross or column stacking. In some such embodiments, the containers may be configured to allow for such interchangeable stacking without impacting ventilation alignment and/or without interfering with stability, strength, and/or stacking tab alignment. Some embodiments may additionally, or alternatively, comprise various locking features that may be used to lock various elements in place and may be used to lock adjacent containers together in a particular configuration. Various additional features and benefits may be provided in connection with particular embodiments, as discussed in detail below.

Figure 1:
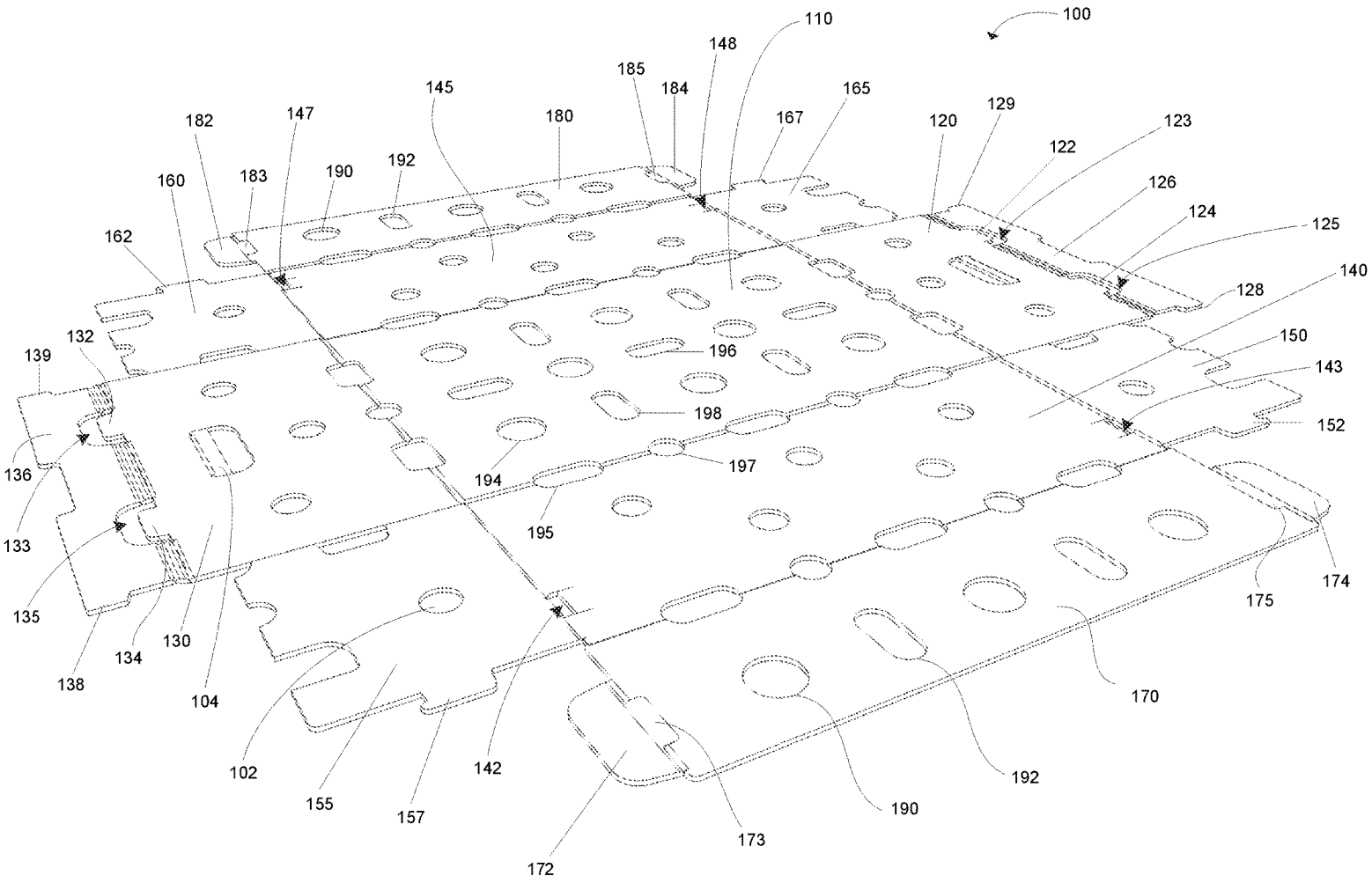
FIG. 1 illustrates a sheet configured for folding into a container consistent with some embodiments.

FIG. 1 illustrates a sheet 100 consistent with embodiments of the present disclosure. Sheet 100 comprises a substantially planar sheet that may be folded into a three-dimensional container. In some embodiments, sheet 100 may comprise a plastic. In some such embodiments, sheet 100 may comprise a corrugated plastic, such as a plastic made up of corrugated flutes.

Sheet 100 comprises a plurality of panels configured to be folded with respect to one another during a folding/assembly process. More particularly, sheet 100 comprises a first panel 110 that, when folded/assembled, will become a bottom to a container and may therefore be referred to herein as a "bottom panel." Similarly, sheet 100 comprises a second panel 120 configured to serve as a side wall of the container, a third panel 130 configured to serve as another side wall of the container opposite from second panel 120, a fourth panel 140 configured to serve as another side wall of the container perpendicular to the side walls formed by second panel 120 and third panel 130, and a fifth panel 145 configured to serve as another side wall of the container opposite from that formed by fourth panel 140.

Sheet 100 further comprises additional panels 150, 155, 160 and 165. Panels 155 and 160 are configured to be positioned adjacent to and at least substantially parallel to panel 130. In the depicted embodiment, panels 155 and 160 are configured to be positioned at least substantially in the same plane. In other words, panels 155 and 160 collectively define a wall adjacent to and parallel with panel 130 such that panels 130, 155, and 160 collectively define a sidewall of the finished container, as will be apparent in connection with other figures discussed below. However, other embodiments are contemplated in which similar panels may instead overlap. Similarly, panels 150 and 165 are configured to be positioned adjacent to and at least substantially parallel to panel 120. In the depicted embodiment, panels 150 and 165 are configured to be positioned at least substantially in the same plane so as to collectively define another sidewall adjacent to and parallel with panel 120.

Panel 120 comprises two locking tabs, namely, locking tab 122 and locking tab 124. As discussed in greater detail below, locking tabs 122 and 124 are configured to be positioned within respective slots defined in other panels to secure a lid or top portion of the container in place. Similarly, panel 130 comprises first locking tab 132 and a second locking tab 134.

Each of the various locking tabs 122/124 and 132/134 is positioned within a corresponding clearance aperture. More particularly, locking tabs 122 and 124 are positioned within clearance apertures 123 and 125, respectively. Similarly, locking tabs 132 and 134 are positioned within clearance apertures 133 and 135, respectively. Clearance apertures 123 and 125 are formed within a first rollover flap 126 and clearance apertures 133 and 135 are formed within a second rollover flap 136. Rollover flaps 126 and 136 are each configured to be folded over against their respective panels (panels 120 and 130, respectively) to expose their respective locking tabs. Clearance apertures 123, 125, 133, and 135 extend about the peripheries of their respective locking tabs other than along a base portion of the locking tabs at which the locking tabs are connected with their respective panels. The functionality of the clearance apertures will be discussed below.

Rollover flaps 126 and 136 further comprise additional locking tabs that extend in a different direction than the respective locking tabs 122/124 and 132/134 of each such rollover flap. More particularly, in the depicted embodiment, rollover flap 126 comprises a locking tab 128 that preferably extends in a direction at least substantially perpendicular to locking tabs 122 and 124 and another locking tab 129 that extends in an opposite direction to locking tab 128, but also at least substantially perpendicular to locking tabs 122 and 124. Similarly, rollover flap 136 comprises a locking tab 138 that preferably extends in a direction at least substantially perpendicular to locking tabs 132 and 134 and another locking tab 139 that extends in an opposite direction to locking tab 138, but also at least substantially perpendicular to locking tabs 132 and 134.

As illustrated in the figures, locking tabs 128/129 and 138/139 each extends beyond a peripheral edge of its respective panels, and a corresponding peripheral edge of their respective rollover flaps. Thus, locking tab 128 extends beyond a first peripheral edge of panel 120 and locking tab 129 extends beyond a second peripheral edge of panel 120 opposite from the first peripheral edge. Similarly, locking tab 138 extends beyond a first peripheral edge of panel 130 and locking tab 139 extends beyond a second peripheral edge of panel 130 opposite from the first peripheral edge. The functionality of this feature of locking tabs 128/129 and 138/139 will be discussed and be more apparent in connection with other figures below.

Panels 140 and 145 each comprises two slots formed at opposite ends of their respective panels. Thus, panel 140 comprises a first slot 142 positioned along a first peripheral edge of panel 140 and further comprises a second slot 143 positioned along a second peripheral edge of panel 140 opposite from the first peripheral edge. Similarly, panel 145 comprises a first slot 147 positioned along a first peripheral edge of panel 145 and further comprises a second slot 148 positioned along a second peripheral edge of panel 145 opposite from the first peripheral edge. Each of these slots 142, 143, 147, and 148 is configured to receive a corresponding locking tab from another panel, as discussed in greater detail below. In some embodiments, one or more (in some embodiments, all) of these slots 142, 143, 147, and 148 may comprise extended side cuts, as shown in FIG. 1, along opposing ends of the respective slots to improve the ease with which their respective locking tabs 128, 129, 138, and 139 can enter the slots during assembly and disassembly.

Each of panels 150, 155, 160, and 165 comprises another respective locking tab. More particularly, panel 150 comprises locking tab 152, panel 155 comprises locking tab 157, panel 160 comprises locking tab 162, and panel 165 comprises locking tab 167. Each of these locking tabs 152, 157, 162, and 167 may comprise a shape that is substantially identical to that of locking tabs 122, 124, 132, and 134. However, unlike locking tabs 122, 124, 132, and 134, locking tabs 152, 157, 162, and 167 may comprise a hooked portion at one end. As discussed in greater detail below, following assembly, locking tabs 122, 124, 132, and 134 are configured to be positioned adjacent to and parallel with locking tabs 167, 152, 162, and 157, respectively, within a corresponding slot from another panel, and the hooked end portions of locking tabs 152, 157, 162, and 167 are configured to engage a peripheral edge of such slot to maintain the container in a desired configuration. These hooked end portions of locking tabs 152, 157, 162, and 167 may also be configured to maintain the finished container in a desired stacked configuration with respect to an adjacent container, as discussed in greater detail below.

Sheet 100 further comprises additional panels 170 and 180, both of which are configured to form a lid or top of a container, and therefore may be referred to herein as "top panels." Each of panels 170 and 180 comprises two corresponding locking flaps. More particularly, top panel 170 comprises a first locking flap 172 at a first end a second locking flap 174 at a second end opposite from the first end. Similarly, panel 180 comprises a first locking flap 182 positioned at a first end and a second locking flap 184 positioned at a second end opposite from the first end.

Each of the various locking flaps 172, 174, 182, and 184 comprises a door extending in the opposite direction relative to the respective locking flap. Thus, locking flap 172 comprises door 173, locking flap 174 comprises door 175, locking flap 182 comprises door 183, and locking flap 184 comprises door 185. As described in greater detail below, each of these doors is configured to pivot to an open position to expose a corresponding slot (see, for example, FIG. 6, in which door 185 has been pivoted to expose slot 186) for receiving locking tabs from other panels upon bending the respective locking flaps with respect to their panels. Although locking flap 184 is depicted as having been pivoted to expose slot 186 in FIG. 6, it should be understood that, in preferred embodiments, each of the various locking flaps, including locking flap 184, may be in a coplanar configuration with its respective door (such as door 185) in a closed positioned prior to engaging its corresponding panel (such as panel 180) with one or more locking tabs.

In some embodiments, sheet 100 may be configured such that, upon folding a panel with respect to one or more other panels during a folding process, one or more locking tabs are configured to automatically engage the door to cause the respective locking flap to bend and expose its corresponding slot. In some embodiments, the locking tabs and locking flaps may be positioned and configured to simultaneously enter the slot and cause the locking flap to pivot during the folding process.

Vent openings may be formed in one or more of the various panels to allow for water and/or air circulation throughout the container. In some embodiments, the vent openings may be configured to allow for placement of a plurality of the containers in either column-stacked or cross-stacked configurations without impeding, or at least without unduly or substantially impeding, air flow through the vent openings.

For example, the embodiment depicted in FIG. 1 comprises a plurality of vent openings formed in top wall panels 170 and 180. These vent openings may comprise various subsets of vent openings having different shapes and/or sizes. For example, sheet 100 comprises a first subset of circular vent openings 190 formed in top wall panels 170 and 180 and a second plurality of non-circular vent openings 192 formed in top wall panels 170 and 180. Non-circular vent openings 192 comprise an elongated or oblong shape. However, those of ordinary skill in the art will appreciate that a wide variety of alternative shapes are possible, both for vent openings 190 and vent openings 192.

Sheet 100 further comprises a plurality of additional vent openings formed in bottom wall panel 110. More particularly, a first subset of circular vent openings 194, a second subset of non-circular, oblong vent openings 198 that are identical, or at least substantially identical, to vent openings 192, and a third subset of non-circular, oblong vent openings 196 that are identical, or at least substantially identical, to vent openings 198 but are rotated by ninety degrees relative to vent openings 198. Vent openings 196 are also positioned to extend down a center portion of bottom wall panel 110 with circular vent openings 194 intermittently positioned in between vent openings 196.

As will be more evident in connection with later figures, rotation of vent openings 198 by ninety degrees relative to vent openings 196 (and 192) may allow for alignment of vent openings with an adjacent container in either column-stacked or cross-stacked configurations without impeding, or at least without unduly or substantially impeding, air flow through the vent openings. Depending upon the position of an adjacent container, vent openings 198 may also serve the dual purpose of receiving tabs or other adjacent projections from two adjacent containers to stabilize the three containers in a desired stacking orientation.

Because of the importance of hydro-cooling for certain types of produce, in some preferred embodiments, the container 100 may be configured such that it has more ventilation openings on the bottom surface (i.e., bottom panel 110) and relatively less ventilation openings on the side panels/walls. For example, in some preferred embodiments, between about 10% and about 30% of the surface area of the bottom wall of the container may be made up of vent openings, which may help with hydro-cooling sprays which typically spray from the top down. Similarly, some such embodiments may comprise top walls and/or panels in which about 10% and about 30% of the surface area is made up of vent openings. In some embodiments, the same, or at least substantially the same, surface area may be open for venting irrespective of whether the resulting containers are cross or column stacked. In other words, in some embodiments, re-orientation of the container from column to cross-stacked does not result in any interference, or at least substantially no interference, with the vent openings alignment.

Because providing too many vent openings in the side panels may be detrimental to strength, it may be preferred that the side panels/walls have substantially less surface area made up of vent openings. For example, in some preferred embodiments, less than about 10% of the surface area of the side walls of the container 100 is made up of vent openings. In some such embodiments, less than or equal to about 3% of the surface area of the side walls of the container 100 is made up of such vent openings.

Some openings may be positioned on edges of sheet 100 between adjacent panels. Thus, for example, sheet 100 comprises a row of openings between panels 110 and 140. These openings may be used for venting and/or for receiving stacking tabs of an adjacent container. In addition, the edge openings may vary in shape and/or size, as with some of the vent openings previously mentioned. For example, opening 195 comprises a non-circular, oblong opening, similar to opening 198, and opening 197 comprises a circular opening. As shown in the figures, these openings may alternate as they extend along one or more of the edges of the sheet 100 and, once folded, may comprise an opening suitable for receiving a stacking tab or similar projection from an adjacent container or, depending upon the orientation/configuration of the adjacent container, allow for suitable venting, as with some of the non-edge openings previously discussed.

Various other vent openings 102 may be placed in other panels of sheet 100, as depicted in FIG. 1. Sheet 100 may further comprise handles 104, which may be positioned on opposing side panels 120 and 130 to improve ease of transport.

Figure 2:
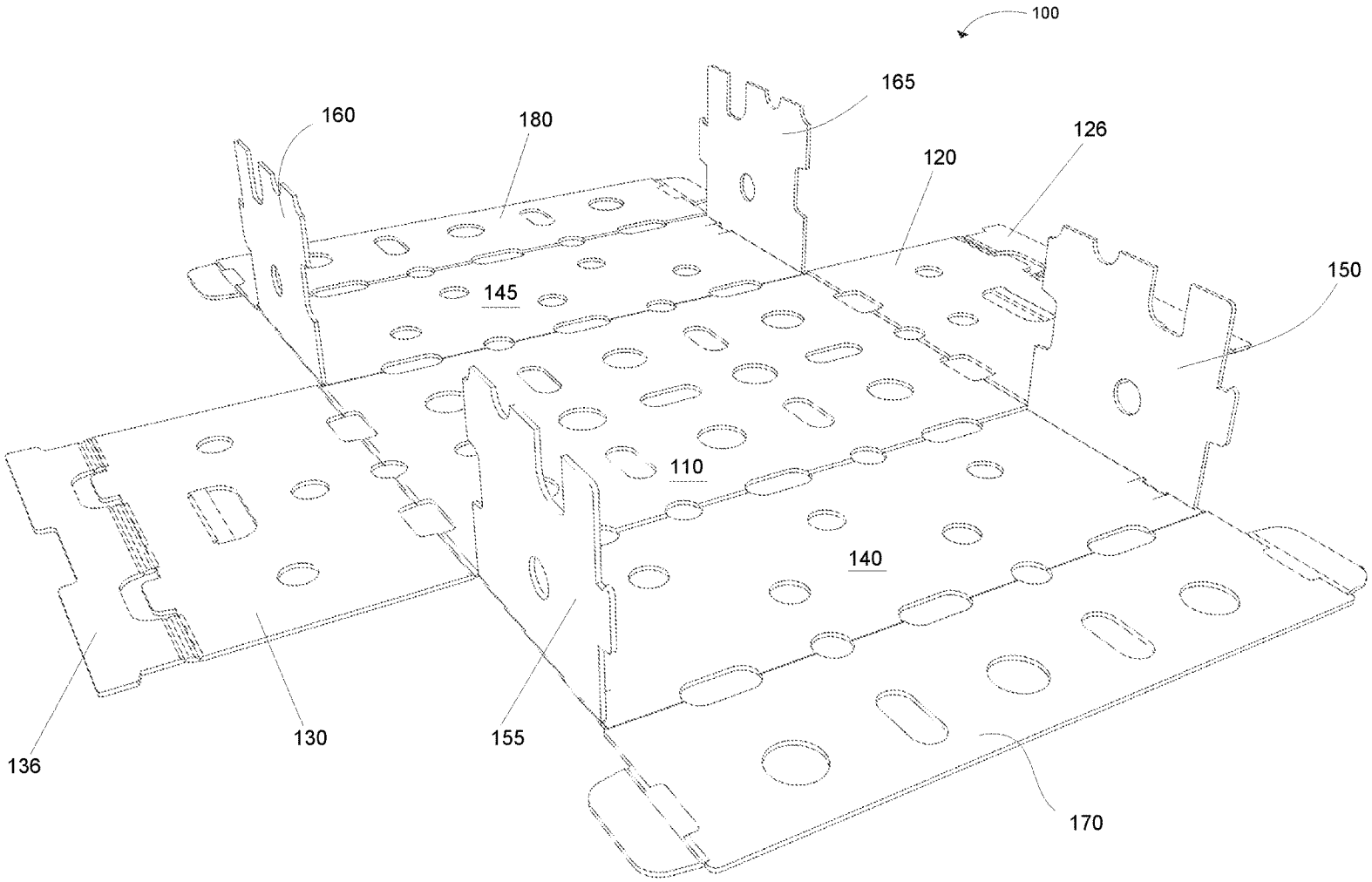
FIGS. 2-6 are perspective views of the sheet of FIG. 1 during various stages of a method for folding/assembling the sheet into a container.

FIG. 2 depicts sheet 100 following an initial series of folding steps for folding the sheet 100 into a container, namely, a box. As shown in this figure, panels 155 and 160 have been folded up and the corresponding panels on the opposite side (panels 150 and 165) have also been folded up.

Figure 3:
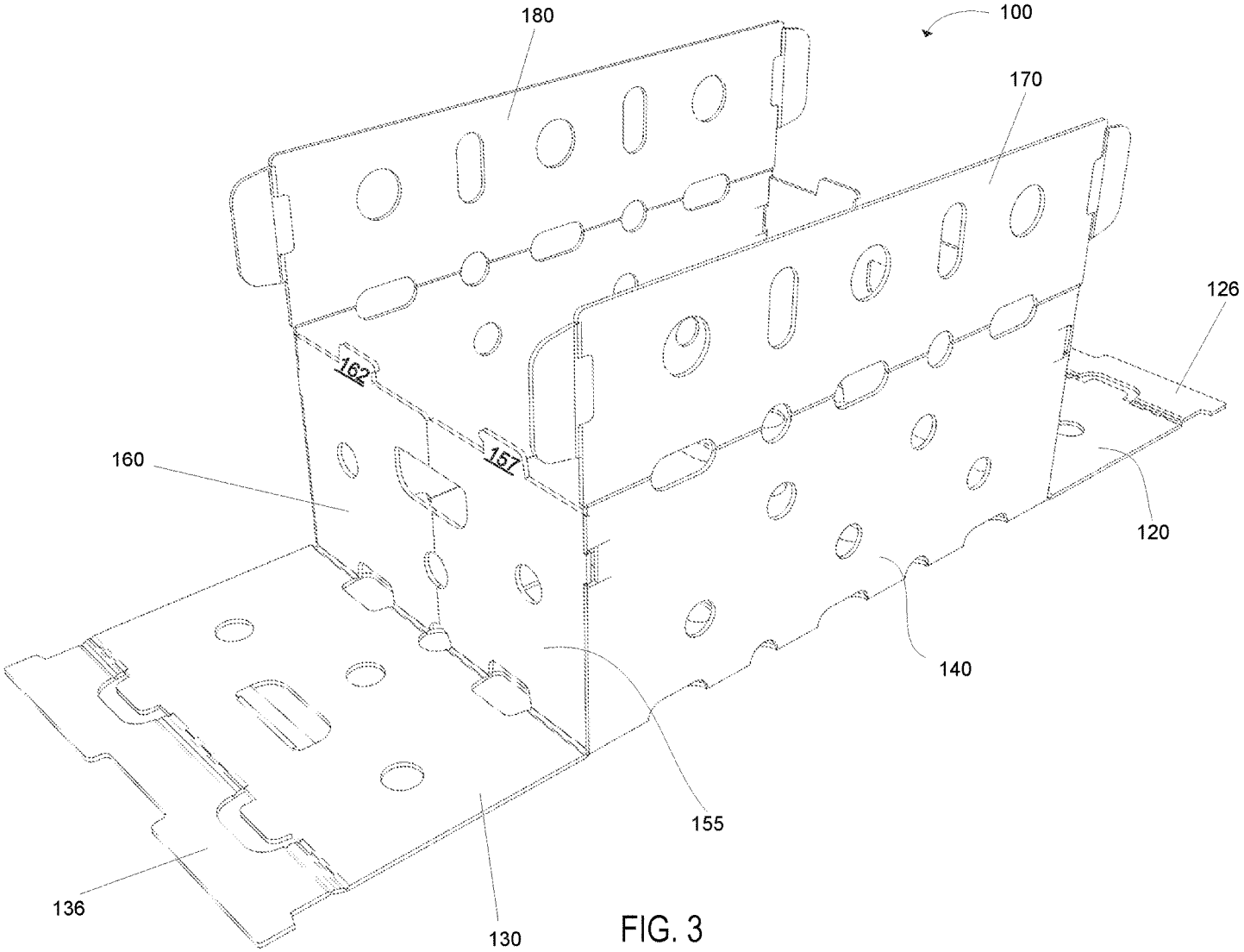

FIG. 3 depicts sheet 100 after additional folding steps have taken place. More particularly, panels 140 and 145 have been folded up such that they define opposite side walls of the container and such that panels 155 and 160 are coplanar and together define another sidewall perpendicular to the sidewall defined by panels 140 and 145 (the same is true for the opposite side).

Figure 4:
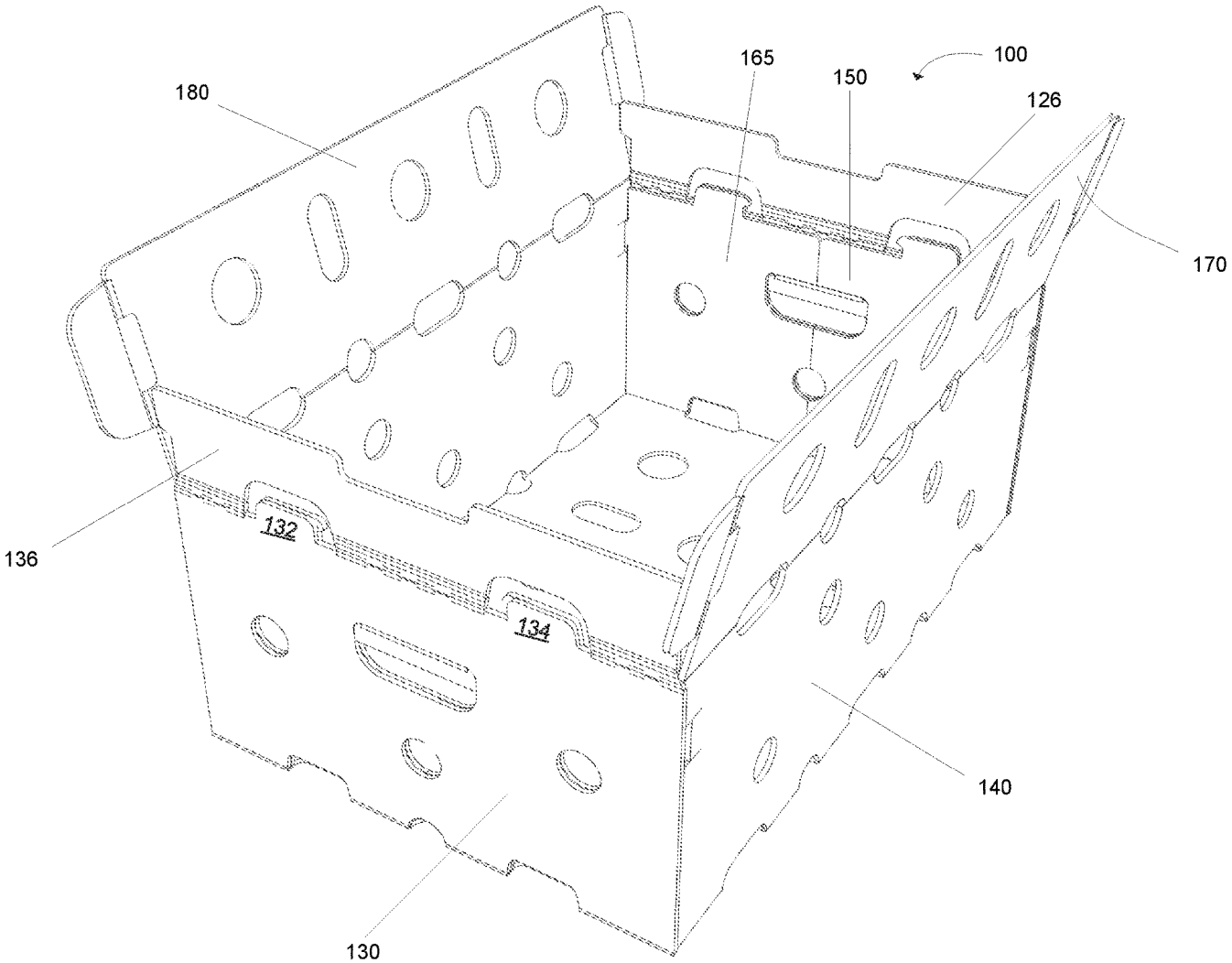

FIG. 4 depicts sheet 100 in another subsequent stage of the assembly/folding process. As depicted in this figure, panels 120 and 130 have been folded up to form a portion/layer of a first side wall that is parallel with coplanar panels 150 and 165 and a similar portion/layer of a second side wall that is parallel with coplanar panels 155 and 160.

Figure 5:
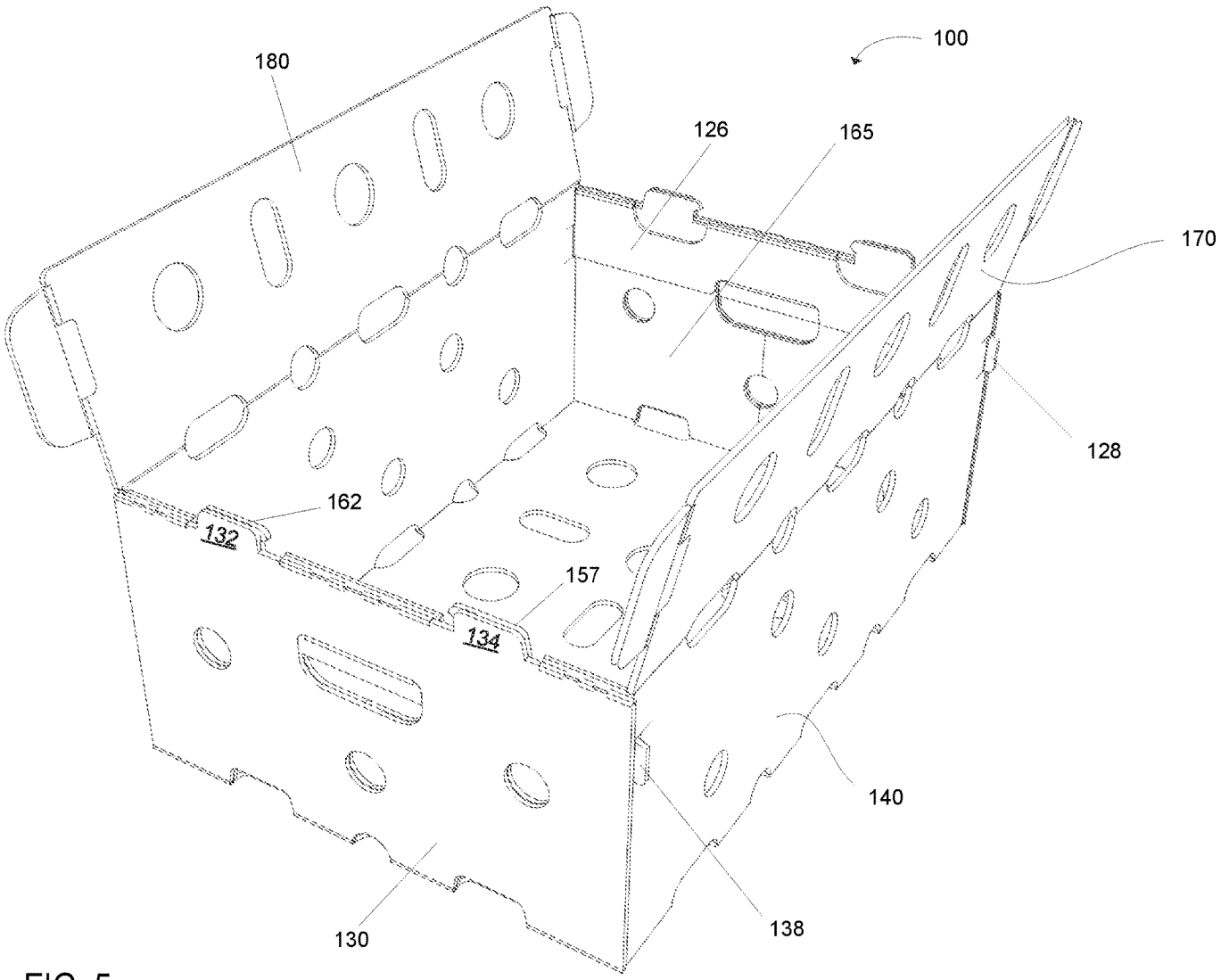

FIG. 5 is another perspective view of sheet 100 following further folding steps. In the state of FIG. 5, rollover flaps 126 and 136 have been folded into the interior of the container and locking tabs 128, 129, 138, and 139 have been inserted into slots 143, 148, 142, and 147, respectively. In some preferred embodiments, slots 142, 143, 147, and 148 may be positioned at least about one inch from the top of the assembled container to ensure integrity and prevent an area of weakness for the container. In preferred embodiments, slots 142, 143, 147, and 148 are positioned in an area of their respective panel that is between 50% of the height of the panel (i.e., with respect to slot 142, 50% of the distance between the border with panel 110 and the border with panel 170) and one inch from the top of the assembled container (i.e., with respect to slot 142, one inch from the border with panel 170).

Figure 6:
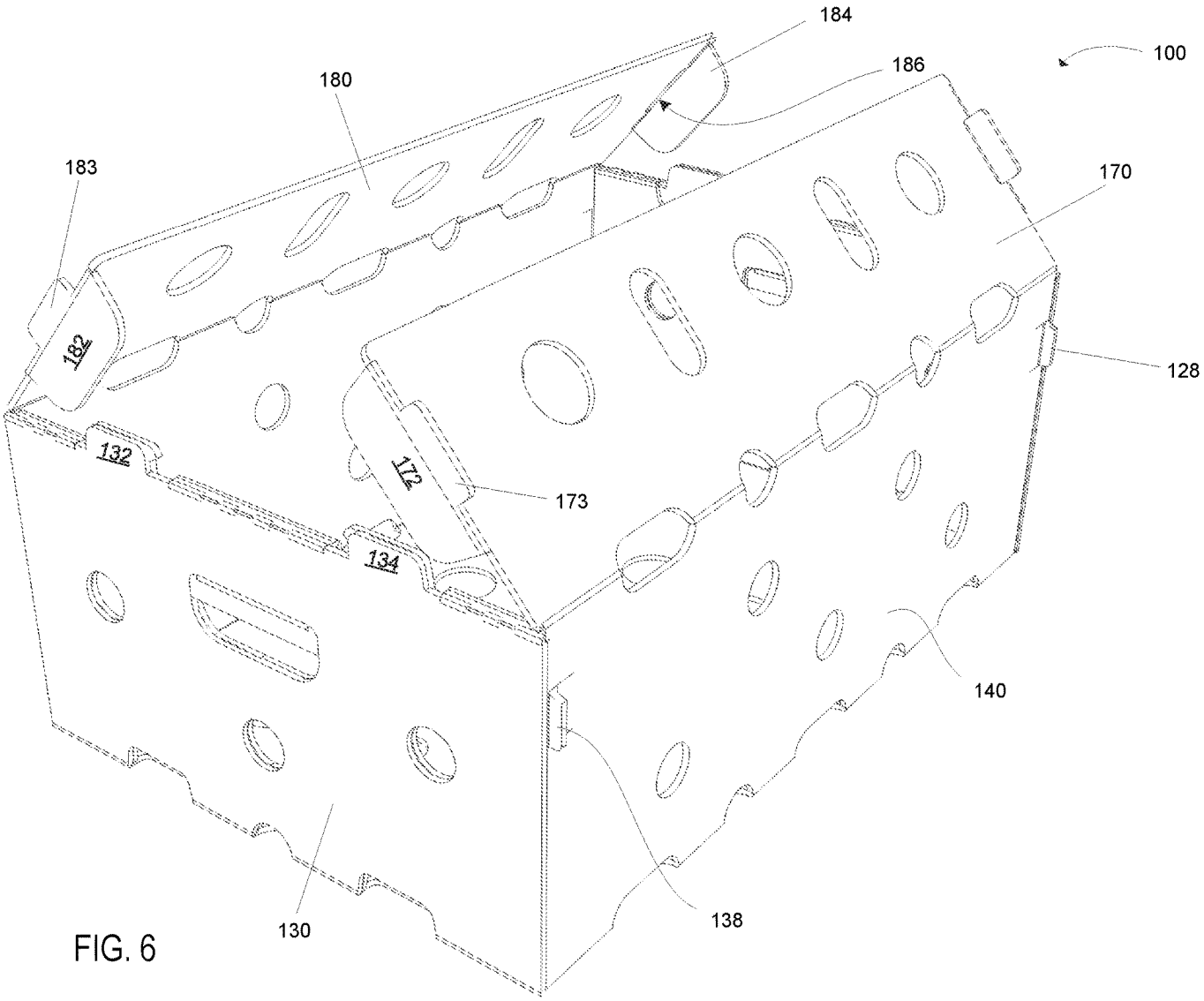

In the stage depicted in FIG. 6, each of the various locking flaps—namely, locking flaps 172, 174, 182, and 184—have been folded/pivoted to expose respective slots formed therein, such as slot 186 exposed upon pivoting locking flap 184. It should be understood, however, that the two top panels—namely, top panels 170 and 180 may instead be folded down to engage one or more locking tabs extending upwards at opposite ends of the container, such that the respective doors of the locking flaps contact the locking tabs to cause the doors to expose the slots for receiving one or more locking tabs and then the locking tabs may simply extend into the slots.

Thus, in the depicted embodiment, folding panel 170 towards locking tabs 134 and 157 may cause locking tabs 134 and 157 to engage door 173 and pivot locking flap 172 to expose a slot (not visible in FIG. 6). Following such engagement, locking flap 172 and door 173 may be positioned parallel to locking tabs 134 and 157 and locking flap 172 may engage the exterior surface of panel 130, as depicted in FIG. 6. The same may be true for the other three sets of locking flaps, doors, and locking tabs.

The various clearance apertures may extend about the peripheries of their respective locking tabs to provide clearance to fold over the rollover flaps without folding over or otherwise deforming the corresponding locking tabs. In addition, these apertures may be configured such that, once the user has folded the rollover flap over the corresponding locking tab(s), the container may be released to allow for repositioning of a user's hands to complete assembly. Because the side walls/panels will naturally try to fall down, the clearance aperture(s) may also allow for an optimal amount of displacement so there is clearance for each of the wider side locking tabs (locking tabs 128/129 and 138/139) to reach its corresponding slot with minimal interaction with the side wall, thereby further decreasing the chance for deformation.

Thus, in certain preferred embodiments, the added width of the clearance aperture(s) relative to the locking tabs positioned within the clearance aperture(s) (locking tabs 122, 124, 132, and 134, for example) may be at least about 65% of the length of the side locking tab(s) (locking tabs 128, 129, 138, and 139, for example). In some embodiments, the added width of the clearance aperture(s) relative to the locking tabs positioned within the clearance aperture(s) may be at least about 75% of the length of the side locking tab(s). In some embodiments, the added width of the clearance aperture(s) relative to the locking tabs positioned within the clearance aperture(s) may be at least about 80% of the length of the side locking tab(s). In some embodiments, the added width of the clearance aperture(s) relative to the locking tabs positioned within the clearance aperture(s) may be between about 60% and about 100% of the length of the side locking tab(s). In some more preferred embodiments, the added width of the clearance aperture(s) relative to the locking tabs positioned within the clearance aperture(s) may be between about 65% and about 85% of the length of the side locking tab(s).

Figure 7:
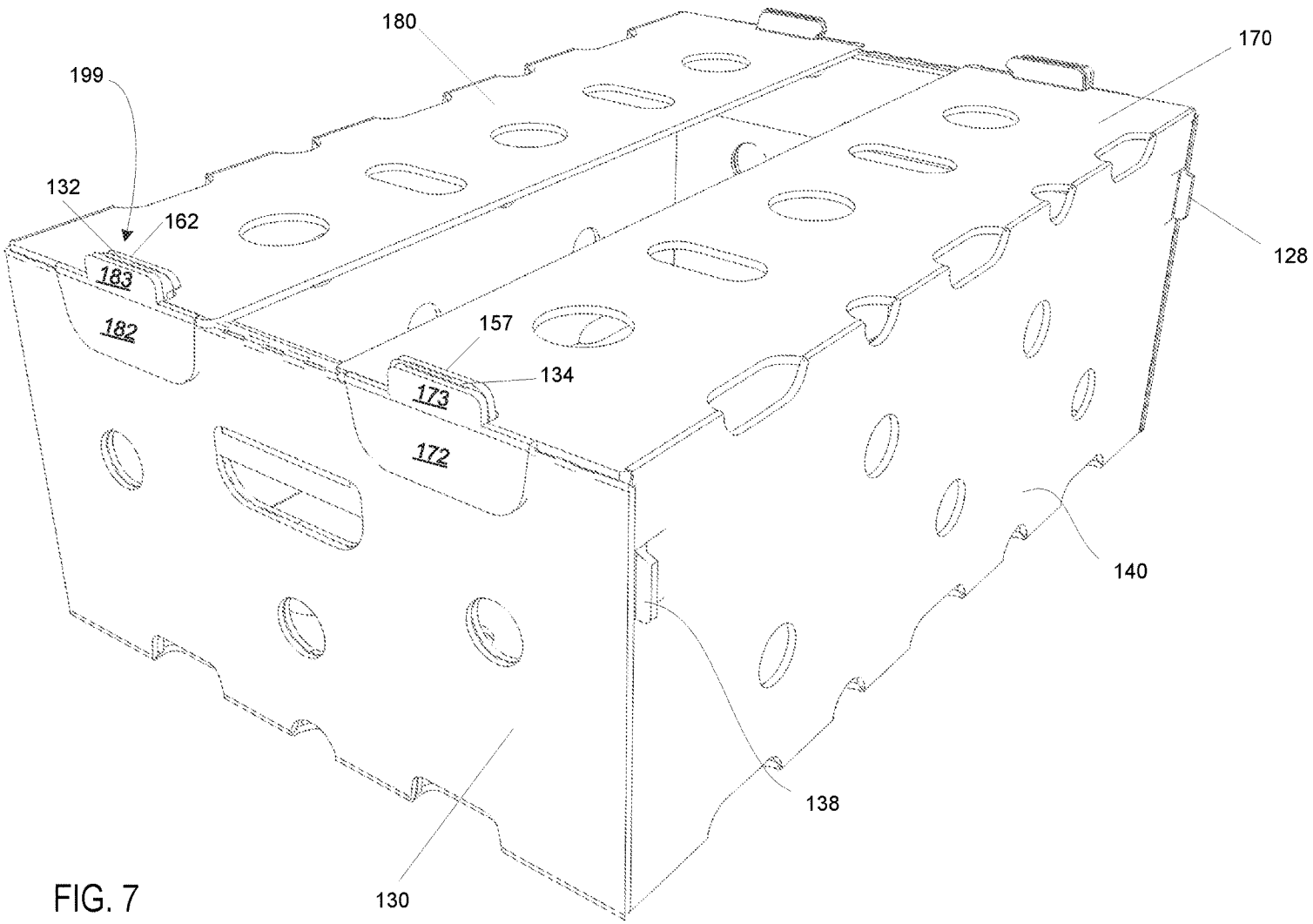
FIG. 7 is a perspective view of the sheet of FIG. 1 following completion of a method for folding the sheet into a container.

FIG. 7 is a perspective view of sheet 100 following completion of the folding process for folding the sheet into a container. As shown in this figure, both top panels 170 and 180 have been folded over to engage its corresponding locking flaps with corresponding locking tabs. In the position shown in FIG. 7, each of the various panels is locked into place to define a sturdy container suitable for use in storing and/or transporting produce, for example. In certain preferred embodiments, the structure and/or materials of the sheet 100 may further be configured to allow for the container to be used multiple times. In certain preferred embodiments, the sheet 100 may therefore comprise a corrugated plastic material.

Similarly, with respect to any of the various embodiments disclosed herein, some such embodiments may be configured such that one or more (in some cases, all) of the various panels are made up of corrugated flutes. In some such embodiments, the corrugated flutes and panels may be configured such that, after assembly into a container, one or more (in some cases, all) of the side locking tabs (e.g., locking tab 138 in sheet/container 100) have corrugated flutes that are angled with respect to (in some cases at least substantially perpendicular to) the corrugated flutes of the panel within which their respective slots have been formed (e.g., slot 142 in panel 140 with respect to sheet/container 100). This may provide for additional rigidity and flexibility for repeated assembly and disassembly. If the flutes of these side locking tabs were instead orientated in the same direction as the panels of their corresponding slots, the side locking tabs may be more prone to bending between the flutes, which could cause the container to be less sturdy.

As also shown in FIG. 7, the various locking tabs/projections projecting from the upper surface of the finished container 100 may collectively define a plurality of stacking tab assemblies. For example, tabs/projections 183, 132, and 162 collectively define a stacking tab assembly 199, which may be configured to fit within a stacking tab opening of an adjacent, identical container positioned above container 100. As will be discussed in greater detail below, in some embodiments, a stacking tab assembly 199 (which, again, may comprise one or more stacking tabs positioned adjacent to one another) may be configured to be received along with a stacking tab assembly of an adjacent, identical container, such as a container positioned in an end-to-end configuration relative to container 100, in a stacking tab opening of an adjacent (above) container.

Figure 8:
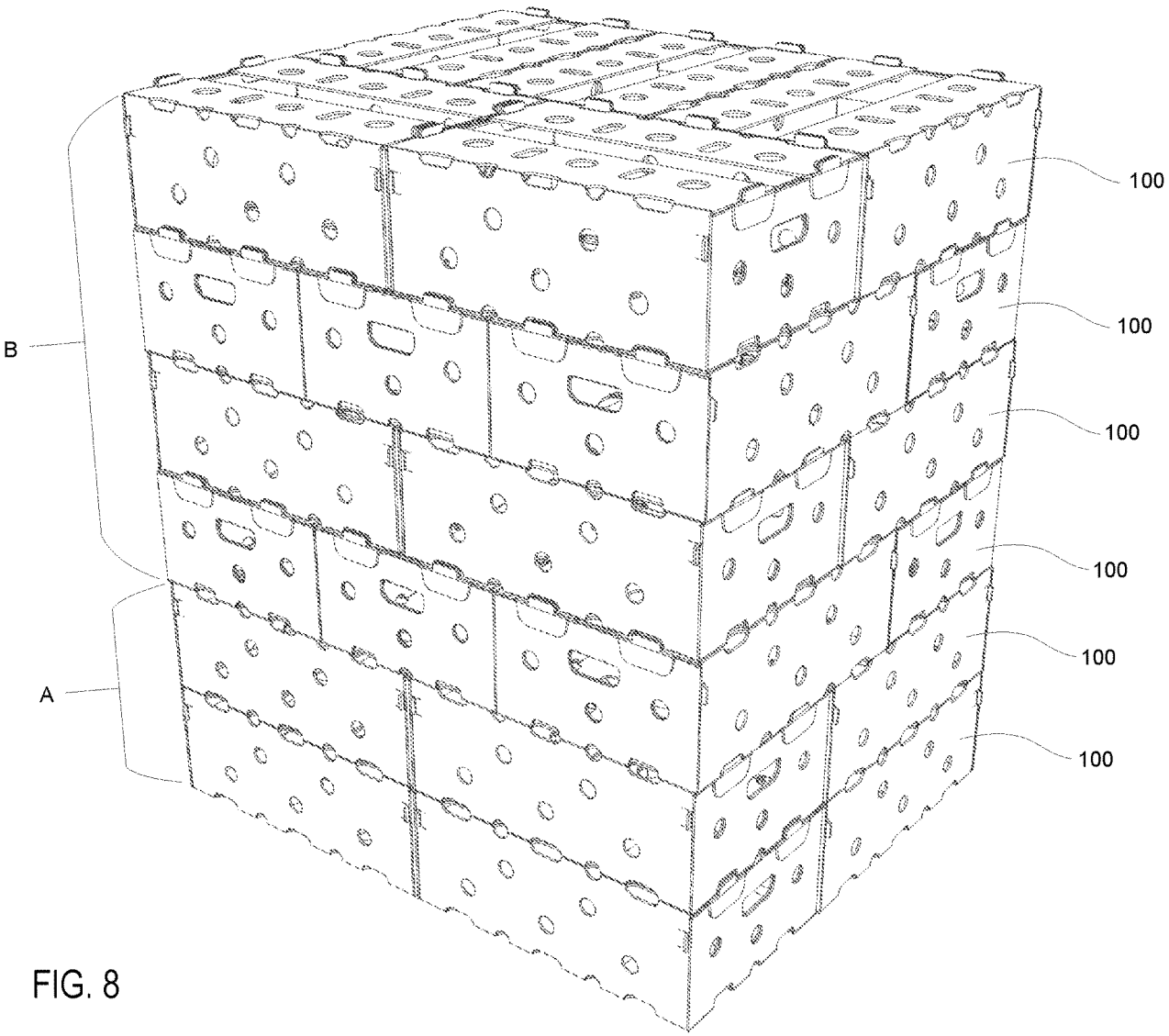
FIG. 8 is a perspective view showing a stack of finished containers, some of which are in a column-stacked configuration and some of which are in a cross-stacked configuration.

FIG. 8 is a perspective view depicting a plurality of stacked containers 100. As shown in this figure, some of the containers are stacked in a cross-stacking configuration and some are stacked in a column-stacked configuration. More particularly, the bottom two layers of the stack (labelled "A") are in a column-stacked configuration and the upper four layers (labelled "B") are in a cross-stacked configuration. As described below, various elements previously mentioned in connection with the sheets of FIGS. 1-7 may be used to improve the ability of the resulting containers 100 to be capable of being alternately stacked in cross and column stacked configurations, such as providing the ability to avoid blocking venting apertures, providing locking features to improve stability between adjacent containers, etc.

Figure 9:
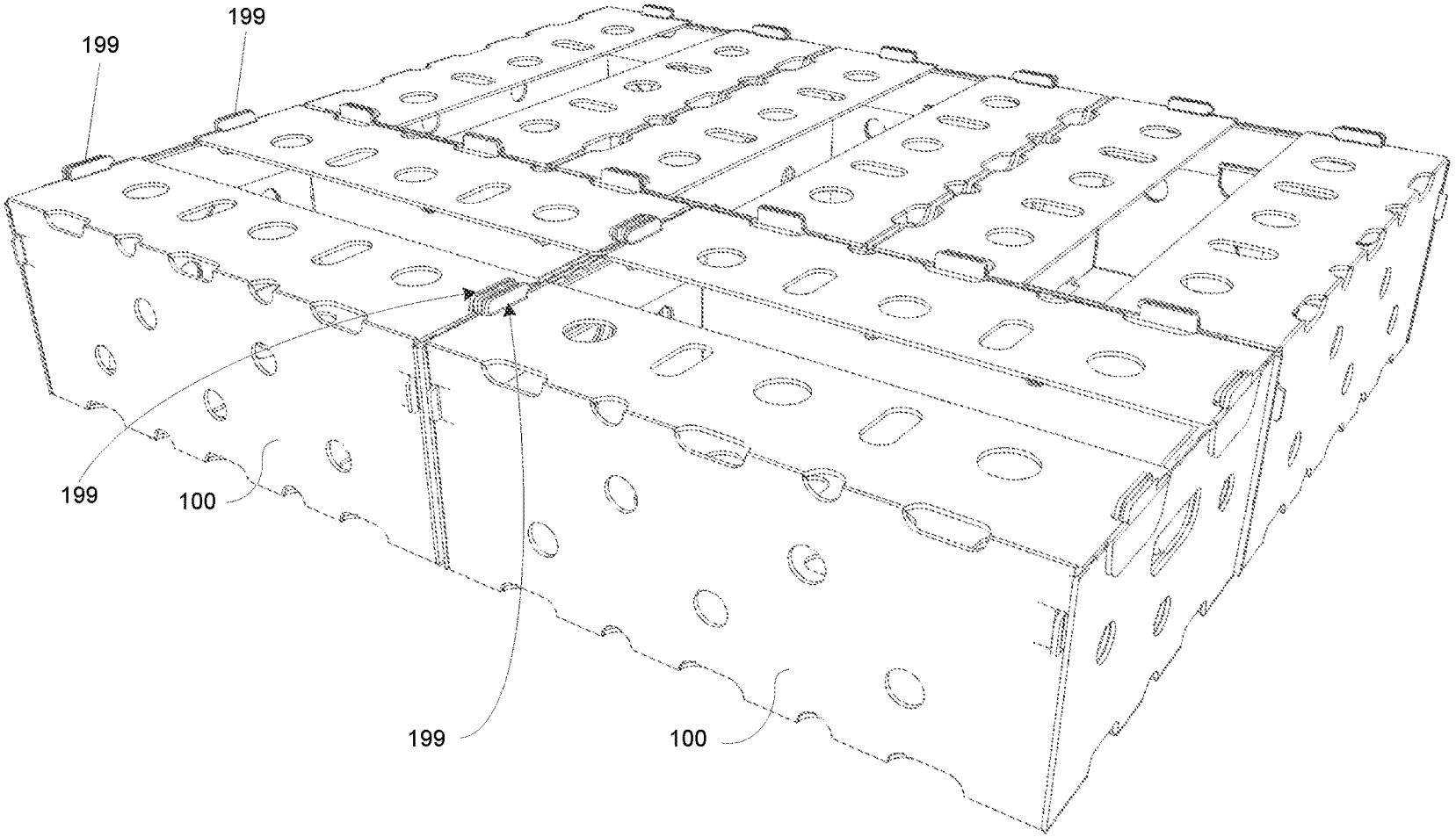
FIG. 9 is a perspective view of a layer of the stack depicted in FIG. 8 and more closely illustrates some of the features of the containers used to facilitate cross and column stacking.

FIG. 9 is a perspective view of the bottom layer of the stack depicted in FIG. 8. As shown in this figure, the various locking tabs and adjacent doors of each container collectively define a stacking tab assembly 199. When containers 100 are aligned longitudinally adjacent (end to end) to one another, a stacking tab assembly 199 of one container 100 may be positioned adjacent to a stacking tab assembly 199 of an adjacent container 100. These two adjacent stacking tab assemblies 199 may then together be received in an opening of an adjacent container positioned above the two containers 100 shown in FIG. 9 in a cross-stacked configuration relative to such containers 100.

As also shown in FIGS. 8 and 9, in some preferred embodiments, the containers may each comprise a length that is about 150% of its width such that three containers may be positioned adjacent to one another in a side-to-side configuration and occupy that same distance as two containers positioned adjacent to each other in an end-to-end configuration. Thus, containers may be alternately stacked in cross- and column stacking configurations, as shown in FIG. 8, while maintaining consistent length by width dimensions.

Figure 10:
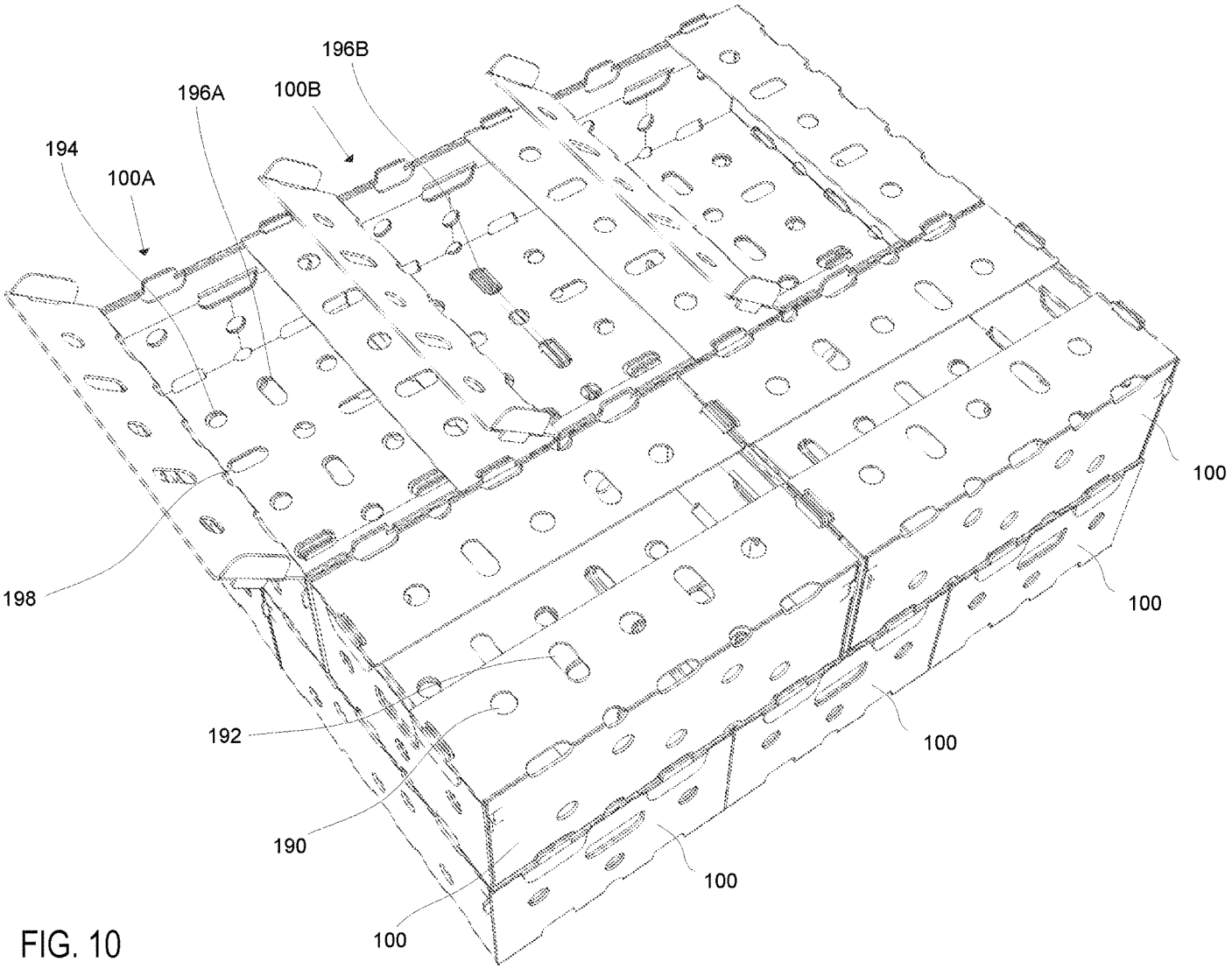
FIG. 10 is a perspective view of a second layer of containers positioned above the layer depicted in FIG. 9.

FIG. 10 is an upper perspective view of such a second layer of containers 100 cross-stacked relative to the containers depicted in FIG. 9. Some of the lids/top panels of the containers 100 have been opened to reveal the interface between the two layers of containers 100. As can be seen in this figure, some of the vent openings are aligned with a vent opening of an adjacent container to allow for cooling/venting therethrough and others are configured to receive tabs/projections from an adjacent container.

Thus, for example, opening 196A on bottom panel 110 of a first container 100A is aligned with a similar opening rotated by ninety degrees (since the two layers of the stack are in a cross-stacked configuration) on an upper panel of an adjacent container 100, such as opening 192. Since these two openings, once rotated, are identical, air flow between the two stacked containers 100 is not impeded.

However, with respect to an identical opening 1966 on bottom panel 110 of a second container 100B adjacent to the first container 100A and at the same layer/level as the first container 100A, the same opening 196B serves as a stacking tab opening, since it receives locking tabs/apertures from two adjacent containers below container 1006, as better seen in FIG. 11, which is discussed below. It should also be understood that both of the "stacking tabs" that fit within stacking tab opening 196B are made up of a plurality of adjacent locking tabs configured for securing panels defining the container 100B in place.

Other openings may be aligned with other openings in adjacent containers irrespective of the position/configuration of the adjacent containers, such as openings 194. Some openings may be configured to be aligned with other openings not having the same shape and/or size yet still avoid blocking desired ventilation. For example, openings 198 on bottom panel 110 may be positioned adjacent to an open region formed between the two top wall panels of an above container such that openings 198 are not blocked by such container.

Figure 11:
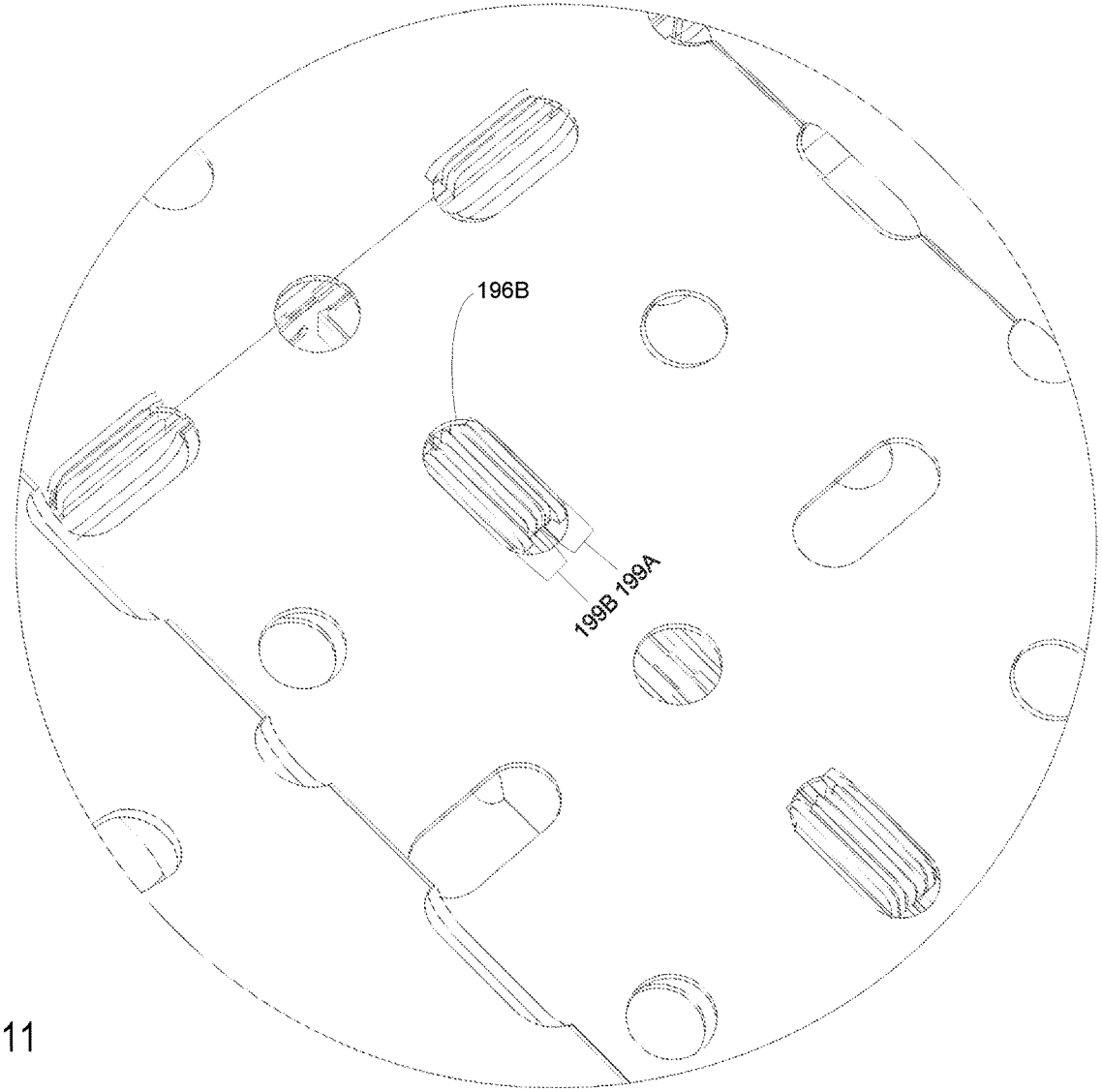
FIG. 11 is a close-up view of an interface between three adjacent containers in the stack of FIG. 10.

FIG. 11 is a close-up view of the interface between the various adjacent containers within stacking tab opening 196B. As better seen in this figure, a first stacking tab assembly 199A made up of a plurality of tabs/projections—such as locking tabs 162 and 132, along with door 183—is positioned adjacent to a similar stacking tab assembly 199B of an adjacent container positioned at the same level and in an end-to-end configuration with respect to the first container, which stacking tab assembly 199B may similarly be defined by three separate locking tabs, projections, and/or doors.

One or more of the tabs/projections/doors of the stacking tab assemblies 199 may have a hooked portion at one or both ends of the respective tab/projection/door. For example, as best seen in FIG. 1, locking tab 157, which is one of the tabs that defines locking assembly 199, comprises a hooked portion at one end of the locking tab 157. This may allow the hooked portion to engage a stacking tab opening 196 of an adjacent container to lock the containers in place, or at least provide a more secure connection therebetween. This hooked portion may, in some embodiments, also serve the purpose of facilitating a more secure connection between various panels of the container after assembly, such as by preventing, or at least inhibiting, locking tab 157 from being removed from the slot exposed by pivoting door 173.

It will be understood by those having skill in the art that changes may be made to the details of the above-described embodiments without departing from the underlying principles presented herein. In addition, any suitable combination of various embodiments, or the features thereof, is contemplated.

Any methods disclosed herein may comprise one or more steps or actions for performing the described method. The method steps and/or actions may be interchanged with one another. In other words, unless a specific order of steps or actions is required for proper operation of the embodiment and/or implementation, the order and/or use of specific steps and/or actions may be modified.

Throughout this specification, any reference to "one embodiment," "an embodiment," or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim require more features than those expressly recited in that claim. Rather, inventive aspects lie in a combination of fewer than all features of any single foregoing disclosed embodiment.

Those having skill in the art will therefore appreciate that many changes may be made to the details of the above-described embodiments without departing from the underlying principles of the invention. The scope of the present invention should, therefore, be determined only by the following claims.

The invention claimed is:

1. A container, comprising:

a first plurality of vent openings formed in a top wall of the container;

a second plurality of vent openings formed in a bottom wall of the container, wherein at least a subset of the first plurality of vent openings is configured to be aligned with at least a subset of a plurality of vent openings formed in a bottom wall of an adjacent container positioned above the container in a column-stacked configuration, and wherein at least a subset of the first plurality of vent openings is configured to be aligned with at least a subset of the plurality of vent openings formed in the bottom wall of the adjacent container in a cross-stacked configuration;

a plurality of stacking tabs; and a plurality of stacking tab openings, wherein each of the plurality of stacking tabs is configured to be received in a stacking tab opening of an adjacent container in a column-stacked configuration, wherein each of the plurality of stacking tabs is configured to be received in a stacking tab opening of an adjacent container in a cross-stacked configuration, wherein at least a subset of the plurality of stacking tabs comprises a plurality of adjacent locking tabs configured to fit within a locking tab slot formed within a panel defining the container for securing the panel defining the container in place, wherein each of the plurality of stacking tab openings is configured to receive a stacking tab of an adjacent container in a column-stacked configuration, and wherein each of the plurality of stacking tab openings is configured to receive a stacking tab of an adjacent container in a cross-stacked configuration.

2. The container of claim 1, wherein the container is configured such that none of the first plurality of vent openings is blocked by an adjacent container in the column-stacked configuration, and wherein the container is configured such that none of the first plurality of vent openings is blocked by an adjacent container in the cross-stacked configuration.

3. The container of claim 2, wherein the container is configured such that none of the second plurality of vent openings is blocked by an adjacent container in the column-stacked configuration, and wherein the container is configured such that none of the second plurality of vent openings is blocked by an adjacent container in the cross-stacked configuration.

4. The container of claim 1, wherein each stacking tab of the at least a subset of the plurality of stacking tabs comprises a stacking tab assembly comprising:

a first locking tab positioned on a first panel of the container;

a second locking tab positioned on a second panel of the container; and a third locking tab positioned on a third panel of the container.

5. The container of claim 4, wherein the third locking flap comprises a door, wherein the door is configured to open to expose a slot for receiving the first locking tab and the second locking tab upon bending the door with respect to the third panel.

6. A container, comprising:

a top wall comprising a first plurality of vent openings;

a bottom wall comprising a second plurality of vent openings, wherein at least a subset of the first plurality of vent openings is configured to be aligned with at least a subset of a plurality of vent openings formed in a bottom wall of an adjacent container positioned above the container in a column-stacked configuration, and wherein at least a subset of the first plurality of vent openings is configured to be aligned with at least a subset of the plurality of vent openings formed in the bottom wall of the adjacent container positioned above the container in a cross-stacked configuration;

a first locking tab extending from the top wall; and a first locking tab slot formed in the bottom wall, wherein the first locking tab is configured to be received in a locking tab slot formed in a first adjacent container positioned above the container in a first cross-stacked configuration along with a locking tab from a second adjacent container extending adjacent and parallel to the container in an end-to-end configuration such that both the first locking tab of the container and the locking tab of the second adjacent container are received within the locking tab slot of the first adjacent container.

7. The container of claim 6, further comprising:

a first side panel, wherein the first locking tab is formed in the first side panel;

a second side panel positioned adjacent and at least substantially parallel to the first side panel; and a second locking tab extending from the second side panel adjacent to the first locking tab, wherein the first locking tab and the second locking tab are configured to be received in the locking tab slot formed in the first adjacent container positioned above the container in the first cross-stacked configuration along with two locking tabs corresponding to the first locking tab and the second locking tab from the second adjacent container extending adjacent and parallel to the container in an end-to-end configuration.

8. The container of claim 7, further comprising a first door configured to extend adjacent and parallel to the first locking tab and second locking tab such that the first door, the first locking tab, and the second locking tab are configured to be received in the locking tab slot formed in the first adjacent container positioned above the container in the first cross-stacked configuration along with two locking tabs and a door corresponding to the first locking tab, the second locking tab, and the first door from the second adjacent container extending adjacent and parallel to the container in an end-to-end configuration.

9. The container of claim 6, wherein the first locking tab slot is one of the second plurality of vent openings, and wherein the first locking tab slot is configured to be aligned with a vent opening formed in a top wall of an adjacent container in a second cross-stacked configuration shifted relative to the first cross-stacked configuration.

10. The container of claim 6, wherein the first plurality of vent openings comprises a first subset of vent openings having a first shape, and wherein the first plurality of vent openings comprises a second subset of vent openings having a second shape distinct from the first shape.

11. The container of claim 10, wherein the second plurality of vent openings comprises a first subset of vent openings having a third shape, and wherein the second plurality of vent openings comprises a second subset of vent openings having a fourth shape distinct from the third shape.

12. The container of claim 11, wherein the second plurality of vent openings comprises a third subset of vent openings having a fifth shape distinct from the third shape and distinct from the fourth shape.

13. The container of claim 12, wherein the third shape is at least substantially identical to the first shape, wherein the fourth shape is at least substantially identical to the second shape, and wherein the fifth shape is rotated by ninety degrees relative to the fourth shape.

14. The container of claim 6, wherein the top wall is defined by a first top wall panel and a second top wall panel, and wherein the first top wall panel is coplanar with the second top wall panel when the top wall is in a closed configuration.

15. The container of claim 14, wherein the top wall comprises an open region positioned between the first top wall panel and the second top wall panel.

16. A sheet for folding into a container, comprising:

a first top panel comprising a first plurality of vent openings;

a first bottom panel comprising a second plurality of vent openings;

wherein the first plurality of vent openings is configured to be aligned with a corresponding plurality of vent openings in an adjacent, identical container in a column-stacked configuration when the sheet has been folded into a container, and wherein at least a subset of the first plurality of vent openings is configured to be aligned with a corresponding plurality of vent openings in an adjacent, identical container extending perpendicular to the container in a cross-stacked configuration when the sheet has been folded into a container;

a plurality of stacking tabs; and a plurality of stacking tab openings, wherein at least a subset of the second plurality of vent openings is configured to be aligned with a corresponding vent opening of an adjacent, identical container in a first configuration relative to the adjacent, identical container, and to alternatively serve as a stacking tab slot for receiving a stacking tab from the adjacent, identical container in a second configuration relative to the adjacent, identical container, wherein each vent opening of the at least a subset of the second plurality of vent openings is configured to receive adjacent stacking tabs from two adjacent, identical containers in the second configuration, and wherein each of the at least a subset of the second plurality of vent openings is spaced apart from opposing sidewalls of the container.

17. The sheet of claim 16, wherein each of the plurality of stacking tabs is configured to be received in a corresponding stacking tab opening of an adjacent, identical container in a cross-stacked configuration, and wherein each of the plurality of stacking tab openings is configured to receive a corresponding stacking tab of an adjacent, identical container in a column-stacked configuration.

* * * * *